United States Patent [19]

Lawson

[11] 4,031,910

[45] June 28, 1977

[54] ARTICULATED SPRAY APPLICATOR PARTICULARLY SUITED FOR USE IN CLEANING FLUES AND THE LIKE

[76] Inventor: Richard L. Lawson, 3272 N. Greenwood Ave., Sanger, Calif. 93657

[22] Filed: Jan. 21, 1976

[21] Appl. No.: 651,032

[52] U.S. Cl. ..... 134/167 C; 134/179; 239/227; 239/243; 239/246; 239/251; 285/134

[51] Int. Cl.[2] ..... B08B 3/02; B08B 9/02

[58] Field of Search ..... 134/115 R, 166 R, 166 C, 134/169 R, 169 C, 171–172, 179; 98/115 R, 115 K; 239/227, 243–246, 248, 251; 285/134, 275

[56] References Cited

UNITED STATES PATENTS

| | | | |
|---|---|---|---|
| 1,375,548 | 4/1921 | Barnes | 98/115 K X |
| 3,150,934 | 9/1964 | Hazard | 239/251 X |
| 3,182,669 | 5/1965 | Campbell et al. | 134/167 R X |
| 3,563,464 | 2/1971 | Doornbos et al. | 239/248 X |
| 3,564,989 | 2/1971 | Williams | 98/115 K |
| 3,595,256 | 7/1971 | Waltman et al. | 134/167 R |
| 3,795,181 | 3/1974 | Lawson | 134/115 R X |

FOREIGN PATENTS OR APPLICATIONS

| | | | |
|---|---|---|---|
| 261,473 | 5/1964 | Netherlands | 239/227 |

*Primary Examiner*—Robert L. Bleutge
*Attorney, Agent, or Firm*—Huebner & Worrel

[57] ABSTRACT

An articulated spray applicator particularly suited for use in cleaning the interior of segmented flues and the like characterized by a plurality of series connected angularly related conduits, each having an internal passage a longitudinal axis and a plurality of spray orifices, each orifice having an axis extended tangentially to a circle concentric to the axis, a stationary support supporting adjoining conduits for rotational movement about the longitudinal axes thereof and interconnecting the passages in a fluid transferring series relationship, and a coupling connecting the passage of at least one of the conduits with a source of fluid under pressure, whereby the fluid is discharged as a spray from the orifices and a turning moment acting about the axes is established for imparting rotation to the conduits.

12 Claims, 4 Drawing Figures

ARTICULATED SPRAY APPLICATOR PARTICULARLY SUITED FOR USE IN CLEANING FLUES AND THE LIKE

BACKGROUND OF THE INVENTION

1. Field of the Invention

The invention generally relates to spray applicators and more particularly to an articulated spray applicator particularly suited for use in cleaning the interior of flues and the like.

2. Description of the Prior Art

The prior art is, of course, replete with spray applicators particularly suited for use as flue cleaning devices. Such applicators often are adapted to be mounted within a flue and utilized for discharging a cleaning fluid under pressure against the wall of the flue in a uniform spray pattern for purposes of removing therefrom deposits of grease, carbon and the like, deposited by flue gases. One such applicator is shown and described in U.S. Pat. No. 3,795,181 to Richard L. Lawson.

While the flue cleaning device shown and described in the aforementioned United States Letters Patent functions quite satisfactorily for its intended purpose, difficulty is encountered in those instances where the flue to be cleaned is characterized by angularly related segments.

It is therefore, the general purpose of the instant invention to provide an articulated spray applicator which is particularly suited for use in cleaning the interior of flues characterized by angularly related segments.

OBJECTS AND SUMMARY OF THE INVENTION

It is, therefore, an object of the invention to provide an articulated spray applicator which overcomes the aforementioned difficulties and disadvantages.

It is another object to provide an articulated spray applicator particularly suited for use in cleaning the interior of flues and the like characterized by angularly related flue segments.

It is another object to provide in an articulated spray applicator a segmented, tubular conduit supported for rotation about the linear axes of the segments thereof.

It is another object to provide in a spray applicator a segmented tubular conduit characterized by angularly related segments, each being supported for rotation about its axis independently of the other segments of the conduit.

It is another object to provide in a spray applicator particularly suited for use in cleaning the internal surfaces of a segmented flue comprising angularly related segments, a segmented tubular conduit, including a plurality of angularly related segments, each segment being supported by a fixed mount for rotation about an axis coincident with the longitudinal axis of symmetry thereof, independently of all other segments of said plurality.

It is another object to provide in a spray applicator a tubular conduit characterized by angularly related segments, each being supported for rotation about the longitudinal axis thereof and having a cylindrical passage extended therethrough, a plurality of orifices, the axes of which are coincident with lines extending in spaced parallelism with a diameter of the passage in intersecting relation with radii of the passage for establishing a turning moment about the axes for thereby imparting rotation to the segments of the conduit as fluid is expelled from the orifices in a spray pattern.

Another object is to provide in a spray applicator a segmented tubular conduit which is particularly useful in connection with the cleaning of grease and the like from segmented flues and similar structures, although not necessarily restricted in use thereto since the applicator of the instant invention may be similarly useful when employed in other environments for other purposes, such as for irrigating elongated, angularly related zones.

These and other objects and advantages are achieved by providing a segmented tubular conduit, the segments thereof being supported for independent rotation by stationary mounts and a plurality of spray orifices, each having an axis extended in angular relation with radii of the passage and in spaced parallelism with a diameter of the segment of the conduit, as will become more readily apparent by reference to the following description and claims in light of the accompanying drawings.

DESCRIPTION OF THE PREFERRED EMBODIMENT

Figure 1:
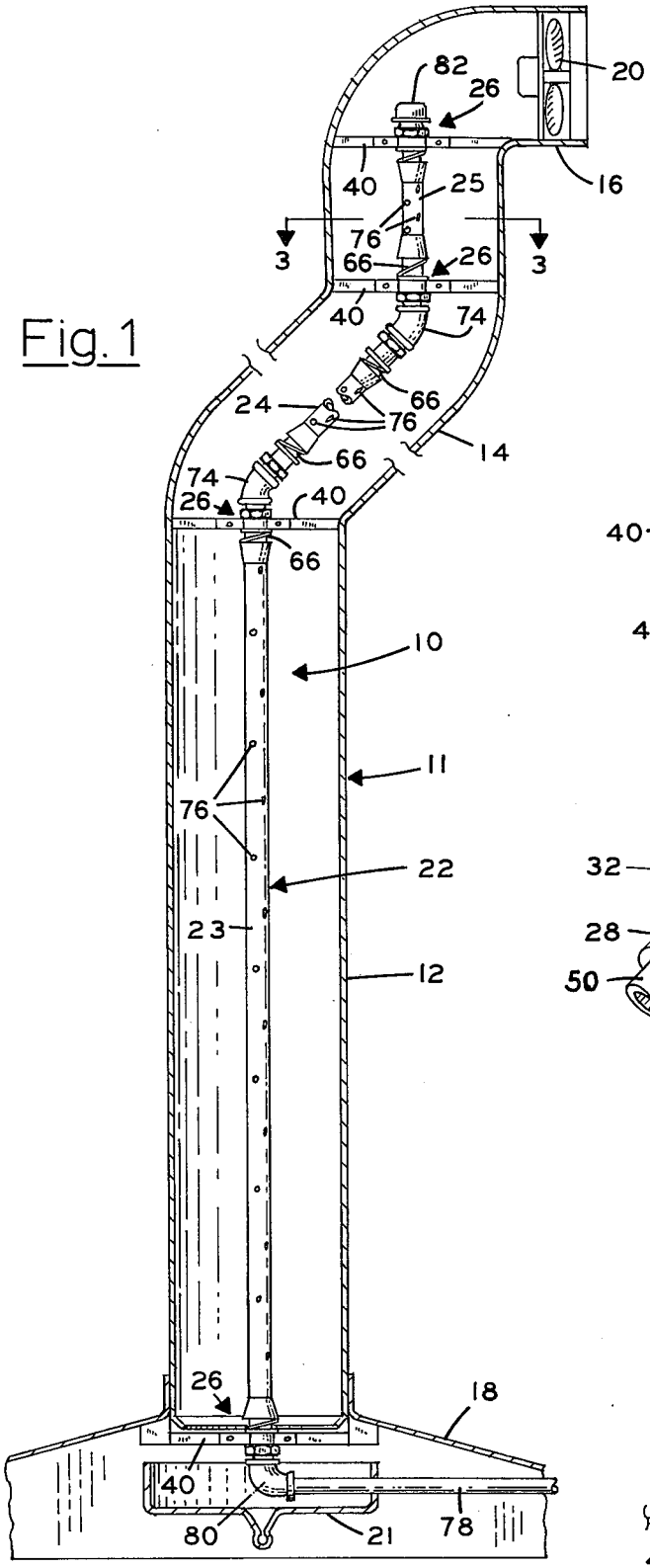
FIG. 1 is a fragmented, vertically sectioned view illustrating a spray applicator, in an operative environment, which embodies the principles of the instant invention.

Referring in greater particularity to the drawings, wherein like reference characters designate like or corresponding parts throughout the several views, there is shown in FIG. 1 a spray applicator, generally designated 10, which embodies the principles of the instant invention.

As illustrated in the drawings, the spray applicator 10 is mounted within a flue of a tubular configuration, generally designated 11. The flue 11 is of any suitable cross-sectional configuration and includes a plurality of angularly related contiguous segments. As shown, the flue 11 includes a vertically oriented base segment 12, an inclined intermediate segment 14 and a discharge segment 16 having a substantially horizontally directed throat, not designated.

The base segment 12 is connected in communication with a collector, such as a hood designated 18, positioned above a grill or the like, not shown, employed in collecting flue gases ladened with atomized particles of grease and carbon. The discharge segment 16 of the flue 11, as shown, includes within its throat a motor-driven fan 20. This fan serves to draw the heated grease and carbon-ladened gases from the hood 18 into the flue 11 and to discharge the same from the flue into a zone remotely related to the hood. As a practical matter, a drip pan 21 is disposed beneath the flue 11 in coaxial alignment therewith which serves to collect fluids, such as condensate, as they gravitate downwardly from the flue.

The spray applicator 10 is an articulated applicator which includes a segmented conduit, generally designated 22. The segmented conduit 22, as shown, includes a base segment 23, an inclined intermediate segment 24 and a terminal segment 25, each having an internal cylindrical passage communicating with each adjacent segment. The adjacent segments 23, 24 and 25 of the segmented conduit 22 are angularly related and concentrically disposed to the segments of the flue 11 within which they are supported.

In order to support the segments 23, 24 and 25 of the conduit 22 within the segments 12, 14 and 16 of the flue 11, there is provided a plurality of mounts 26 disposed within zones of intersections of the segments of the flue. These mounts support the segments of the conduit for independent rotation in an interconnected relationship. Since all of the mounts 26 are of a similar design and function in a similar manner for achieving a similar result, a detailed description of a single one of the mounts 26 is believed to be sufficient.

Figure 4:
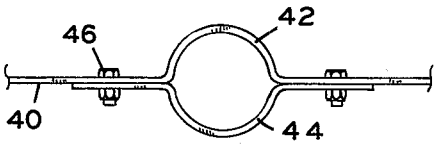
FIG. 4 is a fragmented plan view depicting a spider for supporting the mount shown in FIG. 3.

Each of the mounts 26 includes at least one base fitting 28. Each base fitting, in turn, includes a tubular body having a terminal, screw-threaded end portion 30. Immediately adjacent to the end portion 30 there is disposed an array of angularly related flats 32 which terminate in an annular shoulder, not designated. An annular collar 34 circumscribes the fitting 28 in longitudinally spaced relation with the array of flats 32 so that a neck 36 of a reduced diameter is interposed therebetween. The neck 36, in practice, is received within an annular midportion 38 of a supporting spider 40. The spider 40, as shown in FIG. 4, is of a simplified design and includes at least one pair of legs, not designated, extended from the midportion 38 thereof into connected relation with the wall of the flue 11. Connection of the legs of the spider 40 with the wall of the flue is made employing suitable connectors, such as rivets and the like. Since the particular manner in which the spider 40 is connected to the flue forms no specific part of the instant invention, a detailed description thereof is omitted in the interest of brevity. However, it is to be understood that the spider 40 serves to support the fitting 28 in a fixed concentric relationship with respect to the axis of adjacent segments of the flue 11.

As a practical matter, the midportion 38 of the spider 40 includes an arcuate segment 42 configured to be received by the neck 36 and a clamp 44, having a configuration comprising a mirror image of the arcuate segment 42, connected with the spider employing nut-and-bolt fasteners 46. It is to be understood that the specific structural design of the spider 40 is varied as desired, so long as the spider employed has a capability for supporting a fitting 28 at a desired location within the flue 11.

In view of the foregoing, it should be apparent that the fitting 28 is supported in a fixed relationship with the flue 11 by the spider 40 but that the particular design of the spider and manner in which the spider 40 is connected to the fitting and to the flue form no part of the instant invention.

Figure 2:
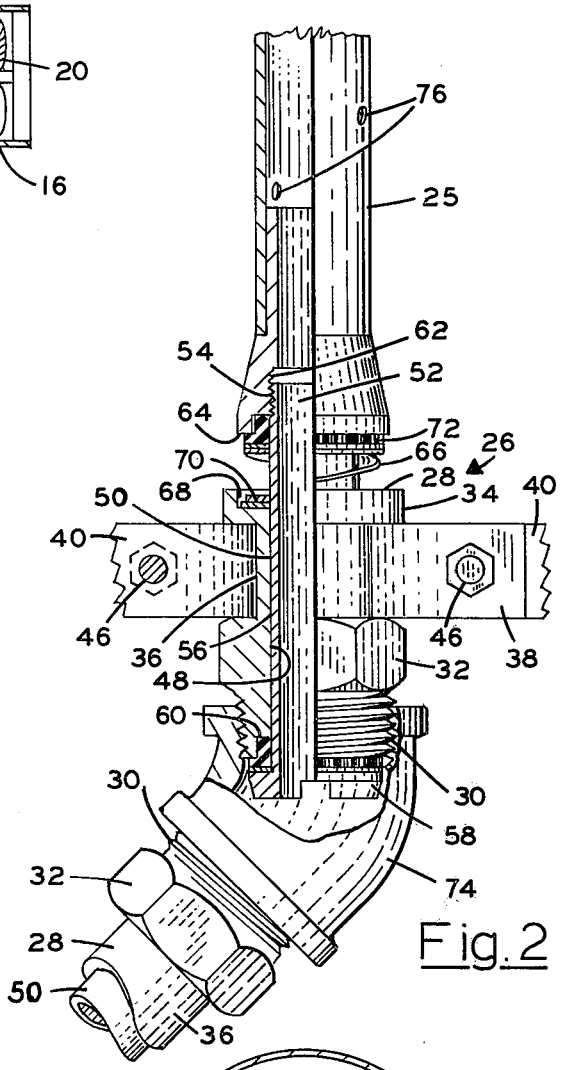
FIG. 2 is an enlarged partially sectioned fragmented view of a supporting mount provided for the applicator shown in FIG. 1.
Figure 3:
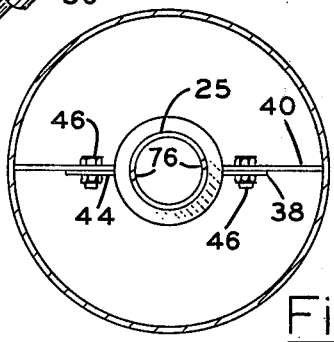
FIG. 3 is a cross-sectional view taken generally along line 3—3 of FIG. 1 illustrating a spider arranged in supporting relationship with the mount shown in FIG. 2.

The fitting 28 also includes a tubular bore 48 of a plain-bearing, cylindrical configuration. Through this bore there is extended in concentric relation therewith a tubular spindle 50. The spindle 50 is characterized by an internal passage 52 of a substantially cylindrical configuration, and a cylindrical external surface which serves as a plain-bearing surface for accommodating axial reciprocation of the spindle relative to the fitting. The external surface of the spindle includes a screw-threaded end portion 54 and a cylindrical midportion 56, FIG. 2. At the end of the spindle 50, opposite the screw-threaded portion 54, there is provided an annular head 58. The head 58 is integrally related with the spindle and is coaxially aligned with the end portion 30 of the fitting 28. As a practical matter, an annular seal 60 is concentrically related to the spindle 50 in interposed relation with the head 58 and the end portion 30 of the fitting 28 for establishing a fluid-tight seal therebetween.

The screw-threaded end portion 54 of the spindle 50 is received by an internal, screw-threaded end portion of the terminal segment 25 of the conduit 22. As illustrated in the drawing, the adjacent portion of the terminal segment 25 is enlarged and includes an annular shoulder 64 arranged in axially spaced relation with the annular collar 34. Hence, it is to be understood that the spindle 50 is supported by the fitting 28 for reciprocation in axial directions.

However, in order continuously to urge the segment 25 away from the adjacent fitting 28, for purposes of maintaining the head 58 in a sealed relationship with the fitting 28, a helical compression spring 66 is interposed between the shoulder 64 of the segment 25 and the annular collar 34 of the adjacent fitting 28. Thus the segment 25 continuously is urged in axial displacement away from the fitting.

As a practical matter, the fitting 28 is provided with an annular socket 68 having seated therein a fiber/nylon washer 70 against which one end of the spring 66 seats while a fiber/nylon washer 72 is arranged in abutting relationship with the opposite end portion of the segment 25. The washers 70 and 72 provide bearing surfaces against which the spring 66 acts as rotary motion is imparted to the segment 25 of the conduit 22.

It is important to note that the threaded portion 30 of the fitting 28 is received within a plumbing fitting 74. As shown, the fitting 74 comprises an elbow characterized by a standard 45° bend. The configuration of the fitting 74, of course, is dictated by the angular relationship of adjacent segments of the conduit. For example, where adjacent segments of the segmented conduit are in coaxial alignment, the fitting 74 comprises a sleeve of a substantially cylindrical configuration.

In any event, the end of the fitting 74, opposite the threaded end portion 30 of the fitting 28 receives a threaded end portion 30 of another fitting 28. This other fitting is, in turn, connected with the adjoining segment 24 of the conduit 22 in substantially the same manner as that hereinbefore described with respect to the connection of the segment 25 with the aforementioned fitting 28. In a similar manner the segment 24 is connected with the segment 23. Thus the interconnected segments 23, 24 and 25 of the conduit 22 are supported for independent rotation by a plurality of mounts 26.

In order to eject fluid as a spray from the segments 23, 24 and 25 of the conduit 22, as well as to impart simultaneous rotation to the segments, each of the segments is provided with a plurality of orifices 76. These orifices, in operation, function as spray distribution orifices having the characteristics of jets. Each of the axes of the orifices is arranged in spaced parallelism with a diameter of the passage extending through the segment of the conduit within which they are formed. As a practical matter, the axes intersect in substantially uniform angular progression about the center of the passage, and forming included angles of less than 90°. Thus the axes of the orifices are angularly related to the radii of the passage so that the resultant jetting action establishes a moment about the axis of the segment as fluid under pressure escapes from the passages through the orifices 76. Unidirectional rotation thus is imparted to the segments as a spray pattern is developed about the conduit 22 for washing-down the internal surface of the flue 11.

Fluid under pressure is delivered to the segmented conduit 22 through a conduit 78. The conduit is connected, preferably, at the base end of the base segment 23 through a suitable fitting such as an elbow 80, threadedly received by the screw-threaded end portion of the adjacent fitting 28 whereby a fluid-tight coupling is established therebetween.

At the opposite end of the segmented conduit 22 there is provided a screw-threaded cap 82 which is received by the screw-threaded portion of the spindle 50 as it extends through the fitting 28 supported by the uppermost spider 40. Thus a hydrostatic head is established within the segmented conduit 22 as fluid under pressure is delivered thereto through the conduit 78.

OPERATION

It is believed that in view of the foregoing description, the operation of the device will readily be understood and it will be briefly reviewed at this point.

With the spray applicator 10 assembled in the manner hereinbefore described, and the segments 23, 24 and 25 of the segmented conduit 22 supported by spiders 40, arranged in axial alignment with the segmented flue 11, the spray applicator 10 is prepared for operation.

As a fluid, preferably a solvent-bearing fluid, is delivered under pressure through the conduit 78 and thence through the communicating segments 23, 24 and 25 of the segmented conduit 22, a hydrostatic head is established therein. Fluid under the pressure of the head is then expelled, through the plurality of orifices 76, to impact against the wall of the flue 11. Simultaneous unidirectional rotation is imparted to each of the segments 23, 24 and 25, each independently of the other, in response to a jetting action of the fluid as it is expelled. The springs 66 serve to assure that a fluid-tight seal is established between the fitting 28 and the adjacent segments of the conduit as the spindle 50 rotates on the seals 60.

As rotation is thus imparted to the segments 23, 24 and 25 of the spray applicator, the fluid discharged through the orifices 76 and impacted against the surfaces of the segment of the flue 11 dislodges deposits of grease, carbon and/or the like from the internal surfaces of the segments of the conduit 22. The fluid, grease, carbon deposit and the like gravitate along the surface of the segmented flue and, ultimately are collected within the drip pan 21. A suitable conduit, not shown, is provided for conducting the fluid from the drip pan 21 to a suitable zone of disposal.

In view of the foregoing, it should readily be apparent that the spray applicator 10 which embodies the principles of the instant invention provides a satisfactory solution to the perplexing problem of washing-down flues characterized by angulated segments in order to reduce the likelihood that combustion will occur within the flue.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A segmented spray applicator particularly suited for use in cleaning flues and the like, characterized by angularly related segments, comprising:

A. a plurality of conduits, each conduit of said plurality having an internal passage communicating with the exterior thereof through a plurality of orifices extended in spaced parallelism with a diameter of the passage;

B. stationary mounting means for supporting adjoining conduits of the plurality of conduits for rotational movement about the longitudinal axes thereof serially interconnecting the passages in fluid communication, said stationary mounting means including a pipe fitting having an internal screw thread disposed between each pair of adjoining conduits, a pair of base fittings received by said pipe fitting and extended oppositely therefrom, and a pair of spindles, each spindle of said pair of spindles being threadedly connected at one end to one conduit of said pair of conduits and supported for rotation by one base fitting of said pair of base fittings; and C. fluid delivery means adapted to connect the passages of said conduits with a source of fluid under pressure, said fluid delivery means including a fluid intake fitting connected to one end of one conduit of said plurality of conduits and a closure member connected to one end of another conduit of said plurality of conduits for maintaining a hydrostatic head of fluid pressure within the plurality of conduits.

2. The applicator of claim 1 wherein said conduits are supported in an angular relationship.

3. The applicator of claim 1 wherein each spindle of said pair of spindles is slidably received in one base fitting of said pair of base fittings and includes an annular head disposed in juxtaposition with one end of the base fitting.

4. The applicator of claim 3 further comprising an annular seal interposed in sealing relation between the head of each spindle and the adjacent end of said base fitting, and a compression spring interposed between said one end of the base fitting and one end of the conduit to which the spindle is connected for resiliently urging the conduit in axial displacement away from the base fitting.

5. A spray applicator for the interior of a flue or the like having a plurality of angularly related successively interconnected segments comprising:

A. Spray conduits individual to the flue segments;

B. means interconnecting the conduits in successive fluid communication and mounting said conduits for independent rotation in their respective flue segments;

C. means for supplying the interconnected conduits with spray fluid under pressure; and D. means for independently rotating the conduits in their respective flue segments.

6. A spray applicator for the interior of a flue or the like having a plurality of angularly related successively interconnected segments comprising:

A. spray conduits individual to the flue segments;

B. means mounted in fixed non-rotational position in the flue at a juncture of successive flue segments interconnecting the conduits in successive fluid communication and mounting said conduits for independent rotation in their respective flue segments, the successive conduits being disposed substantially concentrically of their respective flue segments, and the interconnecting means providing oppositely extended angularly related journals disposed coaxially of their respective flue segments mounting adjacent ends of their respective conduits for rotation thereon; and C. means for supplying the interconnected conduits with spray fluid under pressure, said conduits having orifices therein to emit spray fluid therefrom, said orifices being angularly related to the radii of their respective conduits so that fluid emission therethrough exerts a rotational effect on their respective conduits.

7. A spray applicator for the interior of a flue or the like having a plurality of angularly related successively interconnected segments comprising:

A. spray conduits individual to the flue segments;

B. means interconnecting the conduits in successive fluid communication and mounting said conduits for independent rotation in their respective flue segments; and C. means for supplying the interconnected conduits with spray fluid under pressure, said conduits having orifices therein to emit spray fluid therefrom, said orifices being angularly related to the radii of their respective conduits so that fluid emission therethrough exerts a rotational effect on their respective conduits.

8. The applicator of claim 7 in which the interconnecting means is mounted in fixed non-rotational position in the flue.

9. A spray applicator for the interior of a flue or the like having a plurality of angularly related successively interconnected segments comprising:

A. spray conduits individual to the flue segments;

B. means rigidly mounted in the flue at the interconnections of the segments interconnecting the conduits in fluid communication and mounting the conduits thereon for independent rotational movement extended longitudinally of their respective flue segments; and C. means for supplying fluid under pressure to the conduits, said conduits having orifices therethrough directed outwardly toward the interior of the flue to discharge fluid thereagainst and disposed in substantially parallel spaced relation to diameters of their respective conduits so as to exert a turning moment on the conduits incident to the discharge of fluid therethrough to rotate their respective conduits.

10. The spray applicator of claim 9 in which the interconnecting means has adjacent ends of respective conduits journaled thereon substantially concentrically of the flue.

11. The spray applicator of claim 9 in which the interconnecting means has adjacent ends of respective conduits mounted thereby for rotation and limited axial adjustment relative thereto, and including resilient means urging said conduits longitudinally outwardly of their respective interconnecting means.

12. The spray applicator of claim 9 including washers disposed between the interconnecting means and its respective conduits, and resilient means urging the conduits and interconnecting means into compressive engagement with the washers.

* * * * *